US005695219A

United States Patent [19]

Crawford

[11] Patent Number: 5,695,219

[45] Date of Patent: Dec. 9, 1997

[54] INDEX TAB

[76] Inventor: Larry B. Crawford, 16267 Annatto Ct., Chino Hills, Calif. 91709

[21] Appl. No.: 663,932

[22] Filed: Jun. 14, 1996

[51] Int. Cl.[6] ..... B42F 21/00

[52] U.S. Cl. ..... 283/39; 283/36; 283/42

[58] Field of Search ..... 283/36–42; 40/359; 402/79; 281/38, 42

[56] References Cited

U.S. PATENT DOCUMENTS

| | | | |
|---|---|---|---|
| 3,062,217 | 11/1962 | Woodhouse, Jr. | 40/359 X |
| 3,747,242 | 7/1973 | Hermann | 283/39 X |
| 4,209,925 | 7/1980 | Brugmann | 40/359 |
| 4,660,855 | 4/1987 | Pagliaccio | 40/359 X |
| 5,283,091 | 2/1994 | Darvell | 283/39 X |

*Primary Examiner*—Willmon Fridie, Jr.

[57] ABSTRACT

A new and improved index tab for identifying each individual video tape, audio tape, compact disc, or the like in a collection whereby an index tab having identifying indicia is affixed to the outside of the case containing the tape or disc, the tab being positioned to project beyond the edge of the case when the case is set on the opposite edge so the indicia printed thereon may be easily viewed without requiring movement of the case or assumption of an uncomfortable body position by the viewer, the index tab comprising a clip formed from a strip of thin stiff flexible transparent material such as plastic, the clip having at the top an integral pocket formed therein for receiving a label, the clip also having at the bottom an integral planar base, the base having a coating of pressure-sensitive adhesive on one side whereby the index tab may be attached to the tape or compact disc case, and a planar label formed of stiff paper or the like having a surface suitable for writing upon, the label being releasedly slippedly received inside the pocket such that indicia printed on the label is visible through the transparent plastic of the clip.

4 Claims, 4 Drawing Sheets

INDEX TAB

BACKGROUND OF THE INVENTION

1. Field of the Invention

The present invention relates to labelling devices and more particularly pertains to index tabs which may be used for identifying each individual video tape, audio tape, compact disc, or the like in a collection.

2. Description of the Prior Art

The use of index tabs is known in the prior art. More specifically, index tabs heretofore devised and utilized for the purpose of identifying each individual video tape, audio tape, compact disc, or the like in a collection are known to consist basically of familiar, expected and obvious structural configurations, notwithstanding the myriad of designs encompassed by the crowded prior art which have been developed for the fulfillment of countless objectives and requirements.

The present invention is directed to improving devices for identifying each individual video tape, audio tape, compact disc, or the like in a collection in a manner which is safe, secure, economical and aesthetically pleasing.

For example, U.S. Pat. No. 4,143,477 to Reynolds discloses a variable index tab for a file folder which includes an integral base member adapted to be affixed to the file folder, the base member includes a relatively flat base portion engageable with a surface of the file folder, the base portion having a pair of opposed strip engageable notches at opposite ends of the member, the base portion further includes at least one ear means bent about the base portion and engageable with an opposite surface of the file folder. A rotatable strip of flexible material circumscribes the base portion and engages within the opposed strip engageable notches, the strip carries a series of identifying indicia; the ear means, in one version, can be bent around a fixed axis and a point on the strip is rotatable within a plane which is perpendicular to the fixed axis, in another version, a point in the strip is rotatable within a plane which is parallel to the fixed axis. The rotatable strip can include alphanumeric indicia such as numerals, months, years, dates, and color; alternatively, several rotatable means can be used to indicate multiple indicia, such as days, years, etc. The invention disclosed does not provide a means to record custom information, such as a compact disc title.

The prior art also discloses a tab for index cards as shown in U.S. Pat. No. Des. 268,848 to Lorber which consists of an ornamental design for a tab for index cards consisting of a clip means with an upwardly projecting ear.

U.S. Pat. No. 5,135,261 to Cusack et al. shows an index tab assembly using a label having a coating that facilitates printing on the label, each label is made out of a polyester film having a pressure-sensitive adhesive attached to one side of the film and a coating comprising aluminum oxide, resin chips, methyl ethyl ketone, and toluene, applied to the other side of the sheet; the coating provides good anchorage for toner, abrasive resistance for writing, and electrostatic properties that facilitate printing when using laser or xerographic equipment; the printed label is attached by the pressure-sensitive adhesive directly to a tab of a divider or file to make an index tab, or to a tab reinforcer attached to a tab.

U.S. Pat. No. 3,691,662 to Cunningham describes a laminated index tab construction with a top laminate of transparent film having pressure-sensitive adhesive on lower surface, an intermediate legend laminate with pressure-sensitive adhesive on its lower surface and narrower than top laminate, whereby adhesive-coated skirt portions are provided for attachment of tab to opposed surfaces of a receiving sheet, and lower opaque filler extending from center laterally short of edge of tab to define one skirt portion, with its inner edge facilitating folding of tab during mounting, all mounted on carrier strip; tab edge color coding provided by color ink on legend laminate or strip of color film between latter and top laminate, and optional strip of partial release paper in plane of filler extending from inner edge of latter past skirt portion at that edge of tab to facilitate removal of tab from carrier and attachment of other skirt portion to a sheet requiring additional processing with tab folded.

All three of the inventions disclosed above require opposed surfaces of a receiving sheet for operation making them unsuitable for use on thicker items having essentially one mounting surface.

U.S. Pat. No. 3,747,242 to Heimann describes an index tab which is constructed of self adhesive sheet material protected by a backing sheet; the index tab comprises a larger label portion cut from the adhesive sheet and a smaller index portion cut from the backing sheet; the part of the index tab projecting outwardly from the edge of the card consists of a part of the label portion and the index portion, whereby the upper edges of both are coinciding. The device described is constructed from relatively flimsy sheet material which provides a less useful short operational life span.

In this respect, the index tab according to the present invention substantially departs from the conventional concepts and designs of the prior art, and in so doing provides an apparatus primarily developed for the purpose of identifying each individual video tape, audio tape, compact disc, or the like in a collection whereby an index tab having identifying indicia is affixed to the outside of the case containing the tape or disc, the tab being positioned to project beyond the edge of the case when the case is set on the opposite edge so the indicia printed thereon may be easily viewed without requiring movement of the case or assumption of an uncomfortable body position by the viewer.

Therefore, it can be appreciated that there exists a continuing need for new and improved index tabs which can be used for identifying each individual video tape, audio tape, compact disc, or the like in a collection. In this regard, the present invention substantially fulfills this need.

As illustrated by the background art, efforts are continuously being made in an attempt to develop devices for identifying each individual video tape, audio tape, compact disc, or the like in a collection. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of index tabs now present in the prior art, the present invention provides an improved index tab construction wherein the same can be utilized for identifying each individual video tape, audio tape, compact disc, or the like in a collection whereby an index tab having identifying indicia is affixed to the outside of the case containing the tape or disc, the tab being positioned to project beyond the edge of the case when the case is set on the opposite edge so the indicia printed thereon may be easily viewed without requiring movement of the case or assumption of an uncomfortable body position by the viewer. As such, the general purpose of the present invention, which will be described subsequently in greater detail, is to provide a new and improved index tab apparatus and method which has all the advantages of the prior art index tab and none of the disadvantages.

The invention is defined by the appended claims with the specific embodiment shown in the attached drawings. For the purpose of summarizing the invention, the invention may be incorporated into a new and improved index tab for identifying each individual video tape, audio tape, compact disc, or the like in a collection whereby an index tab having identifying indicia is affixed to the outside of the case containing the tape or disc. The tab being positioned to project beyond the edge of the case when the case is set on the opposite edge so the indicia printed thereon may be easily viewed without requiring movement of the case or assumption of an uncomfortable body position by the viewer. The index tab comprises a clip formed from a strip of thin stiff flexible transparent material such as plastic. The clip has an integral upper display component laterally folded back upon itself parallel to the fixed plane whereby a pocket with an open bottom and open sides is formed. The clip also has an integral planar lower base component coated with pressure-sensitive adhesive on one side whereby the index tab may be attached to the tape or compact disc case. The clip additionally has release paper releasedly applied over the exposed surface of the pressure-sensitive adhesive whereby protecting the adhesive prior to use. The clip further has a lateral raised shoulder formed immediately below the open bottom of the pocket whereby blocking the opening. The index tab also has a planar label formed of stiff paper or the like having a surface suitable for writing upon. The label has a generally rectangular shape, having a length and width and thickness corresponding to the inside space of the pocket of the clip. The label is releasedly slippedly received inside the pocket such that indicia printed on the label is visible through the transparent plastic of the display component.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved index tab for identifying each individual video tape, audio tape, compact disc, or the like in a collection whereby an index tab having identifying indicia is affixed to the outside of the case containing the tape or disc, the tab being positioned to project beyond the edge of the case when the case is set on the opposite edge so the indicia printed thereon may be easily viewed without requiring movement of the case or assumption of an uncomfortable body position by the viewer, the index tab comprising a clip formed from a strip of thin stiff flexible transparent material such as plastic, the clip having at the top an integral pocket formed therein for receiving a label, the clip also having at the bottom an integral planar base, the base having a coating of pressure-sensitive adhesive on one side whereby the index tab may be attached to the tape or compact disc case, and a planar label formed of stiff paper or the like having a surface suitable for writing upon, the label being releasedly slippedly received inside the pocket such that indicia printed on the label is visible through the transparent plastic of the clip.

It is therefore an additional object of the present invention to provide a new and improved index tab which has all the advantages of the prior art index tabs and none of the disadvantages.

It is another object of the present invention to provide a new and improved index tab which may be easily and efficiently manufactured and marketed.

It is a further object of the present invention to provide a new and improved index tab which is of a durable and reliable construction.

An even further object of the present invention is to provide a new and improved index tab which is susceptible of a low cost of manufacture with regard to both materials and labor, and which accordingly is then susceptible of low prices of sale to the consuming public, thereby making such index tab s economically available to the buying public.

Still yet another object of the present invention is to provide a new and improved index tab which provides in the apparatuses and methods of the prior art some of the advantages thereof, while simultaneously overcoming some of the disadvantages normally associated therewith.

Still yet another object of the present invention is to provide a new and improved index tab which is specifically configured to be used with collections of plastic-cased items like video tapes, audio tapes, or compact discs where the manufacturers original labelling is often difficult to read.

Yet another object of the present invention is to provide a new and improved index tab that also provides a means to identify a lost or stolen items that have been equipped with a tab.

Even still another object of the present invention is to provide a new and improved index tab which facilitates organizing collections according to categories or groups.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
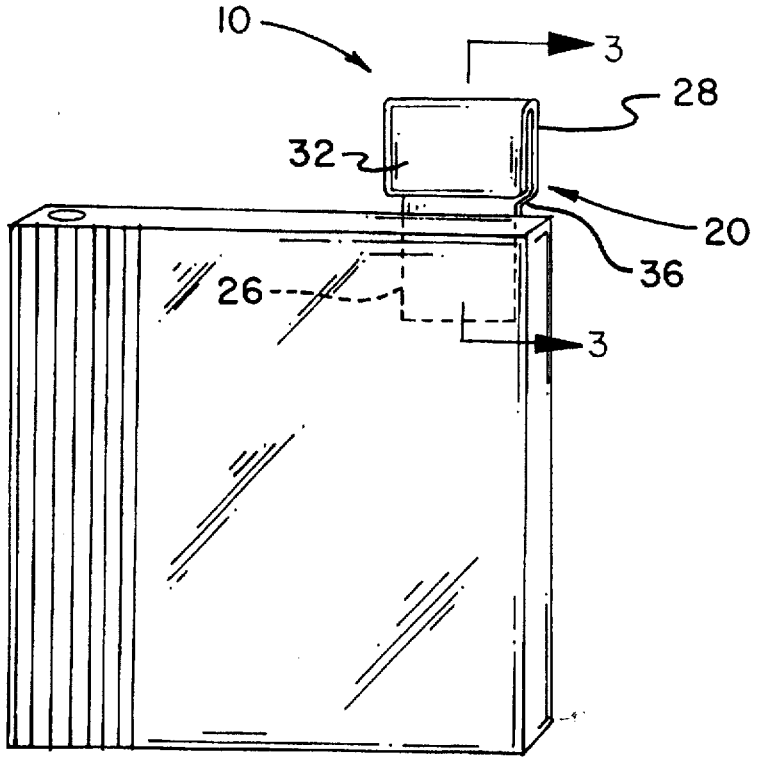
FIG. 1 is a perspective view of the preferred embodiment of the invention shown installed on a typical compact disc case.
Figure 2:
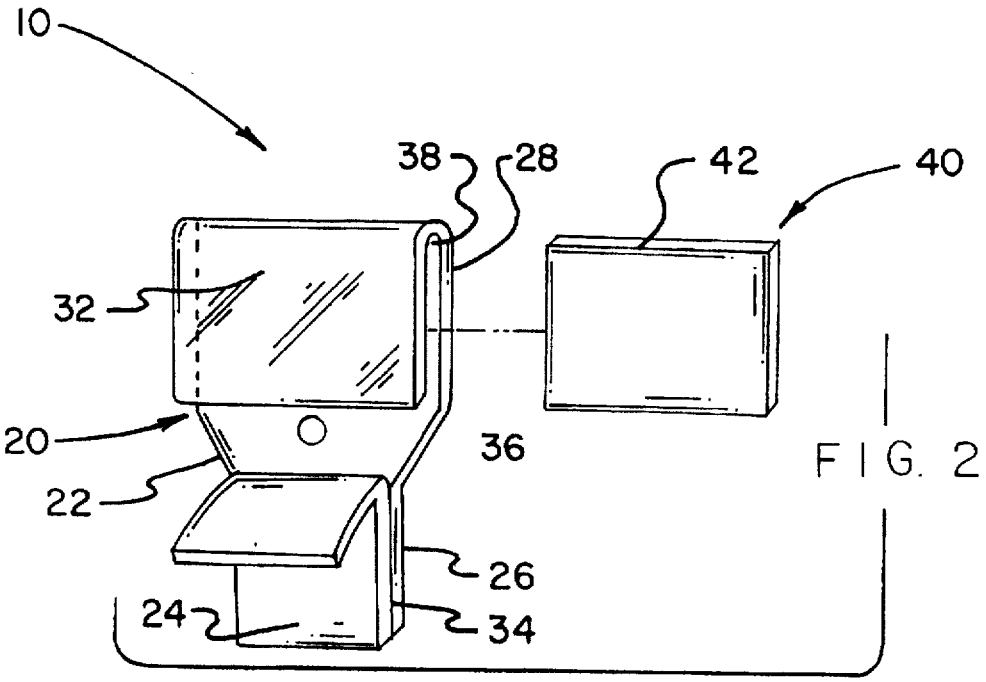
FIG. 2 is an exploded perspective view of the invention of FIG. 1 showing the label and pressure-sensitive adhesive protecting release paper.
Figure 3:
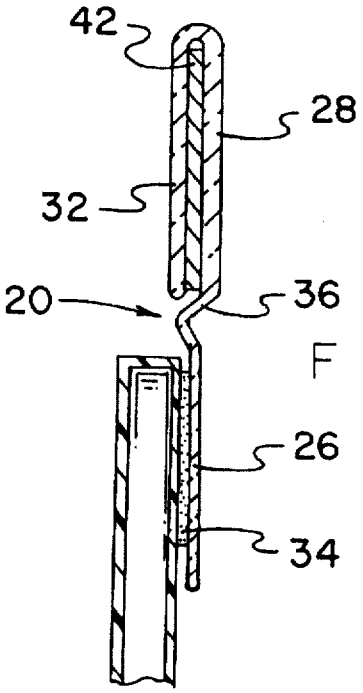
FIG. 3 is a sectional view of the invention of FIG. 1 taken along the line 3—3.
Figure 4:
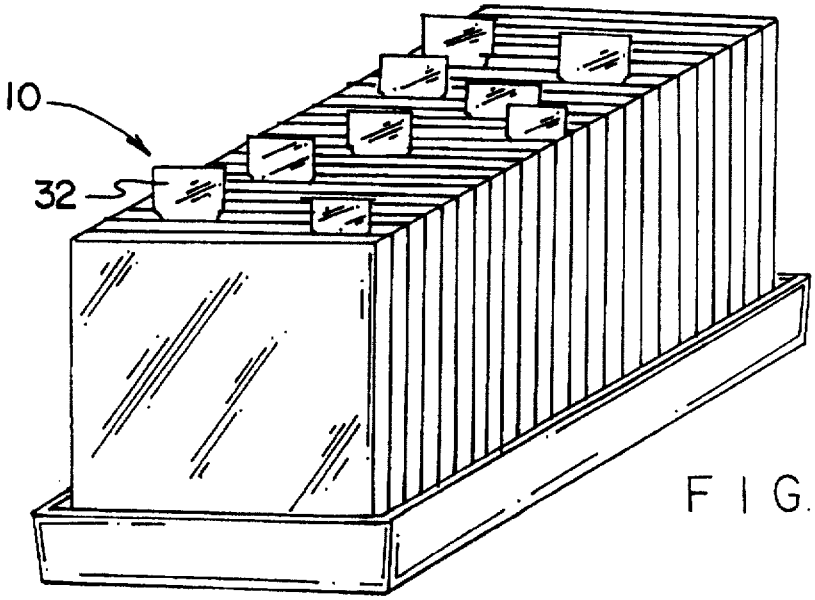
FIG. 4 is a perspective view illustrating a typical application of the device installed on a plurality of compact discs within a collection arranged on a typical compact disc rack.
Figure 5:
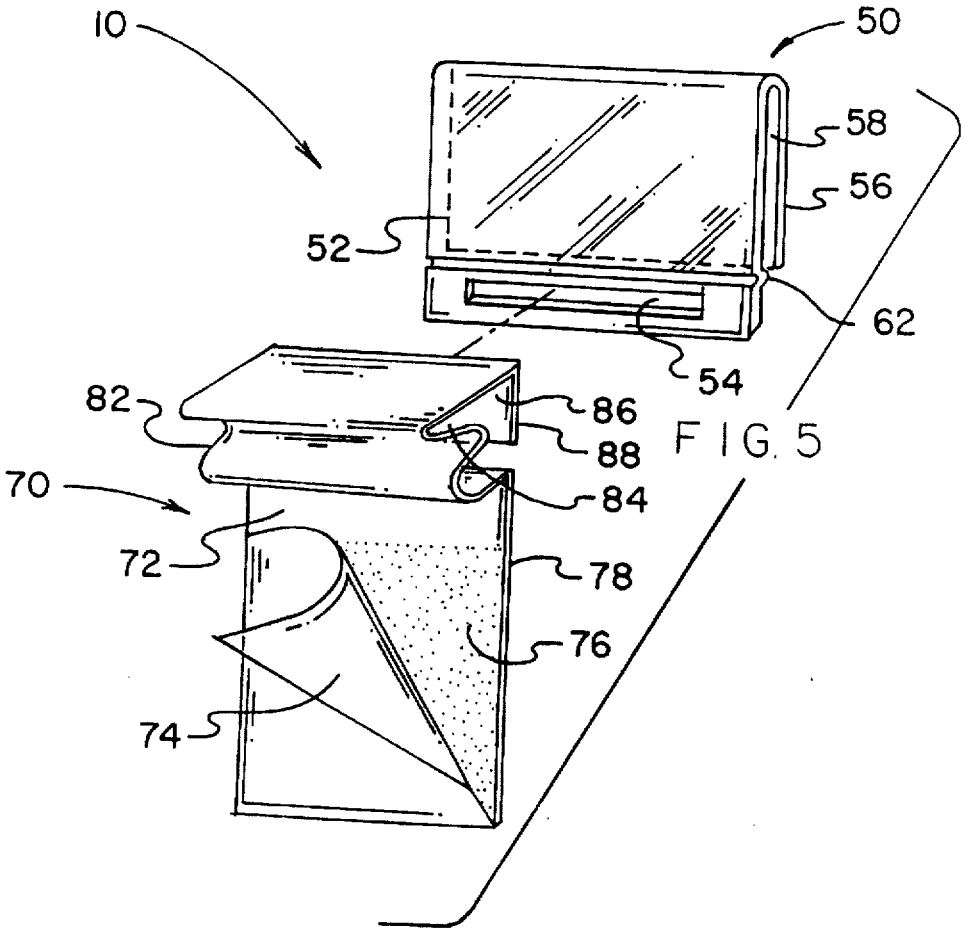
FIG. 5 is an exploded partial perspective view of a second embodiment of the invention depicting a two piece index tab where the top piece may be tilted for better viewing.
Figure 6:
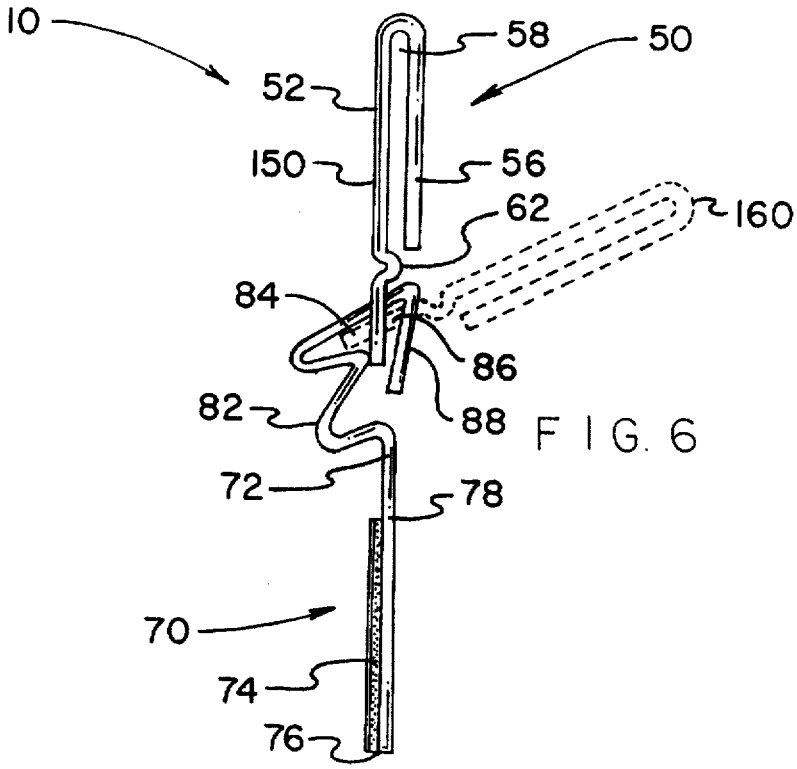
FIG. 6 is a side elevational view of the invention of FIG. 5 characterizing the manner of operation of the hinged dual-angle top piece.
Figure 7:
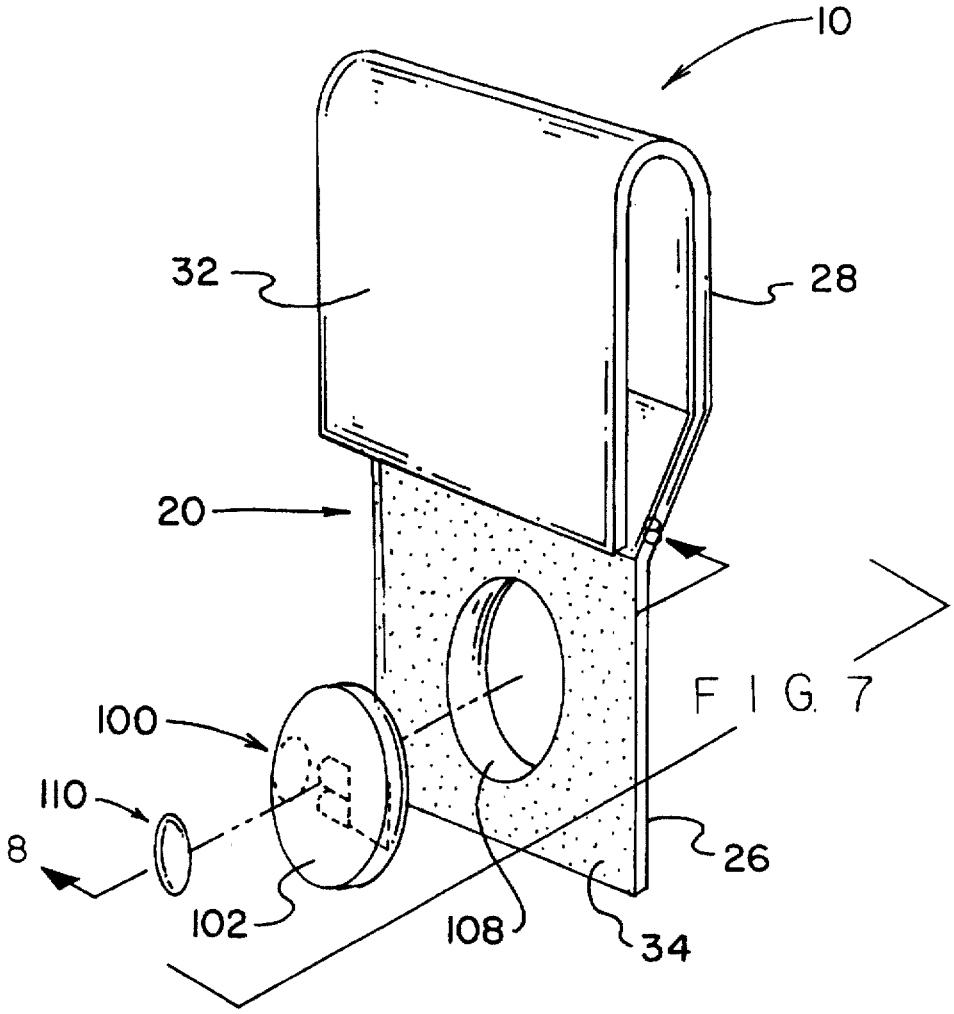
FIG. 7 is an exploded partial perspective view of a first modification of the preferred embodiment of the invention shown in FIG. 1 which adds a theft protection means.
Figure 8:
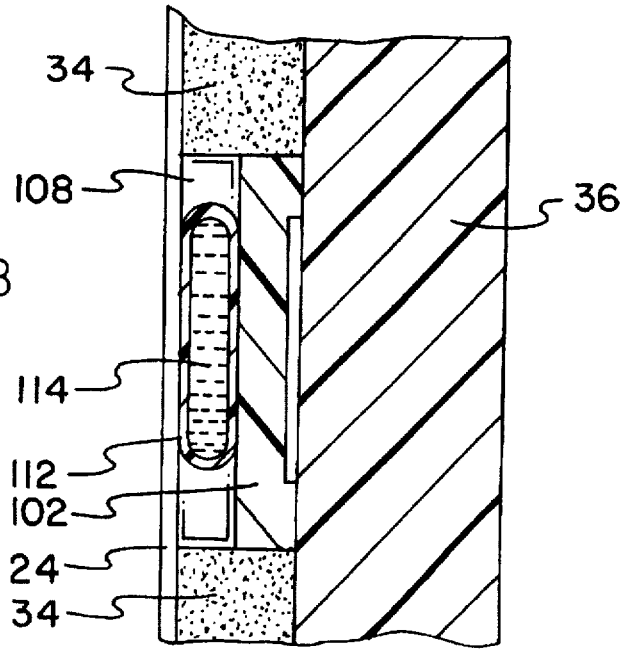
FIG. 8 is a detail sectional view of the invention of FIG. 7 illustrating the placement of the security label and glue capsule.

With reference now to the drawings, and in particular to FIG. 1 thereof, a new and improved index tab embodying the principles and concepts of the present invention and generally designated by the reference numeral 10 will be described.

From an overview standpoint, the index tab is adapted for use in identifying each individual video tape, audio tape, compact disc, or the like in a collection whereby an index tab having identifying indicia is affixed to the outside of the case containing the tape or disc, the tab being positioned to project beyond the edge of the case when the case is set on the opposite edge so the indicia printed thereon may be easily viewed without requiring movement of the case or assumption of an uncomfortable body position by the viewer. See FIG. 1.

With reference now to FIGS. 1 through 4, more specifically, it will be noted that a index tab 10 identifies each individual video tape, audio tape, compact disc, or the like in a collection whereby an index tab 10 having identifying indicia is affixed to the outside of the case containing the tape or disc. The tab 10 being positioned to project beyond the edge of the case when the case is set on the opposite edge so the indicia printed thereon may be easily viewed without requiring movement of the case or assumption of an uncomfortable body position by the viewer.

The index tab 10 comprises a clip 20 formed from a strip of thin stiff flexible transparent material such as plastic. The clip 20 has an integral upper display component 28 laterally folded back upon itself 32 parallel to the fixed plane whereby a pocket 38 with an open bottom and open sides is formed. The clip 20 also has an integral planar lower base component 36 coated with pressure-sensitive adhesive 34 on one side whereby the index tab 10 may be attached to the tape or compact disc case.

The clip 20 additionally has release paper 24 releasedly applied over the exposed surface of the pressure-sensitive adhesive 34 whereby protecting the adhesive prior to use. The clip 20 further has a lateral raised shoulder 36 formed therein immediately below the open bottom of the pocket 38 whereby blocking the opening. The index tab 10 also has a planar label 40 formed of stiff paper 42 or the like having a surface suitable for writing upon.

The label 40 has a generally rectangular shape, having a length and width and thickness corresponding to the inside space of the pocket 38 of the clip. The label 40 is releasedly slippedly received inside the pocket 38 such that indicia printed on the label is visible through the transparent plastic of the display component.

A first modification of the preferred embodiment further includes theft protection means 100 whereby the case of the tape compact disc, or the like is permanently marked with identifying indicia, such as a serial number, during installation of the index tab 10. The theft protection means 100 comprises a clear zone 108 in the pressure-sensitive adhesive coating 34 of the base component 26 having an area essentially one-quarter the area of the adhesive coating wherein there is no adhesive.

The clear zone 108 is centrally located on the pressure-sensitive adhesive-coated surface. The theft protection means 100 also includes a thin planar security label 102 formed of abrasion-resistant material, such as acrylic, having dimensions essentially the same as those of the clear zone 108. The security label 102 has a thickness essentially one-half the thickness of the pressure-sensitive adhesive coating 34. The security label 102 has identifying indicia fixedly inscribed on one side. The security label 102 is disposed on a plane parallel to the plane of the base component 26, in touching relationship with the base component 26, within the clear zone 108 of the adhesive coating 34 whereby the indicia may be viewed through the transparent material of the base component.

The theft protection means 100 additionally includes a glue capsule 110 fixedly connected to the side of the security label 102 opposite the inscribed indicia. The glue capsule 110 comprises a thin-walled hollow bladder 112 having a length and width slightly smaller that of the security label 102 and an overall thickness essentially one-half that of the adhesive coating 34 of the base component.

The bladder 112 also has a liquid anaerobic adhesive 114, such as cyanoacrylate ester, therein. The bladder 112 is formed of pliable easily burst material whereby normal pressure exerted on the pressure-sensitive adhesive 34 during installation of the index tab 10 will cause the bladder 112 to rupture whereby the liquid anaerobic adhesive 114 flows between the security label 102 and the tape or compact disc case (not shown) to form a permanent bond.

The theft protection means 100 further includes release paper 24 releasedly applied over the exposed surface of the pressure-sensitive adhesive 34 whereby protecting the adhesive prior to use. The release paper 24 is also applied over the security label 102 and glue capsule 110 whereby retaining the security label and glue capsule captively in place prior to installation of the index tab 10.

In a second modification of the preferred embodiment of the index tab 10, the transparent material is colored whereby the indexed items may be color-coded for quick visual identification of a category or group of items.

In a second embodiment of the invention, the index tab 10 is adjustable over two viewing angles when the case is set on the opposite edge so the indicia printed thereon may be easily viewed without requiring movement of the case or assumption of an uncomfortable body position by the viewer.

The index tab 10 comprises an upper display component 50 formed from a strip of thin stiff flexible transparent material such as plastic. The upper display component 50 is laterally folded back upon itself 56 parallel to the fixed plane whereby a pocket 58 with an open bottom and open sides is formed. The upper display component 50 also has a lateral raised shoulder 62 formed therein immediately below the open bottom of the pocket 58 whereby blocking the opening.

The upper display component 50 further has a lateral slot 54 therethrough located parallel with and below the lateral raised shoulder 62. The index tab 10 also includes a lower base component 70 formed from the same material as the upper display component 50. The lower base component 70 has a width essentially the same as the width of the lateral slot 54 of the upper display component 50. The lower base component 70 also has, at the top, a series of lateral corrugations 82 formed therein.

The corrugated top 82 of the lower base component 70 snapidly hingedly cooperatively extends through the lateral slot 54 of the upper display component 50 such that the upper display component 50 rotates on the lower base component 70 about the slot 54 whereby the corrugations form a two-position detent 84 and 86 whereby the upper display component 50 may be adjusted so it is either coplanar 150 with the lower base component or angled 160 with respect to the plane of the lower base component 70.

The lower base component70 also has, at the bottom, a planar section 78 having a coating of pressure-sensitive adhesive 76 on one side whereby the index tab 10 may be attached to the tape or compact disc case. The lower base component 70 further has release paper 74 releasedly applied over the exposed surface of the pressure-sensitive adhesive 76 whereby protecting the adhesive prior to use. The index tab 10 further includes a planar label 40 formed of stiff paper 42 or the like having a surface suitable for writing upon.

The label has a generally rectangular shape and a length, width, and thickness corresponding to the inside space of the pocket 58 of the upper display component 50. The label 40 is releasedly slippedly received inside the pocket 58 such that indicia printed on the label is visible through the transparent plastic of the clip display component.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new and improved index tab for identifying each individual video tape, audio tape, compact disc, or the like in a collection whereby an index tab having identifying indicia is affixed to the outside of the case containing the tape or disc, the tab being positioned to project beyond the edge of the case when the case is set on the opposite edge so the indicia printed thereon may be easily viewed without requiring movement of the case or assumption of an uncomfortable body position by the viewer, the index tab comprising:

a clip formed from a strip of thin stiff flexible transparent material such as plastic, the clip having an integral upper display component laterally folded back upon itself parallel to the fixed plane whereby a pocket with an open bottom and open sides is formed, the clip also having an integral planar lower base component coated with pressure-sensitive adhesive on one side whereby the index tab may be attached to the tape or compact disc case, the clip additionally having release paper releasedly applied over the exposed surface of the pressure-sensitive adhesive whereby protecting the adhesive prior to use, the clip further having a lateral raised shoulder formed therein immediately below the open bottom of the pocket whereby blocking the opening; and a planar label formed of stiff paper or the like having a surface suitable for writing upon, the label having a generally rectangular shape, the label having a length and width and thickness corresponding to the inside space of the pocket of the clip, the label being releasedly slippedly received inside the pocket such that indicia printed on the label is visible through the transparent plastic of the display component.

2. The index tab of claim 1 and further including theft protection means whereby the case of the tape compact disc, or the like is permanently marked with identifying indicia such as a serial number during installation of the index tab, the theft protection means comprising:

a clear zone in the pressure-sensitive adhesive coating of the base component having an area essentially one-quarter the area of the adhesive coating wherein there is no adhesive, the clear zone being centrally located on the pressure-sensitive adhesive-coated surface;

a thin planar security label formed of abrasion-resistant material such as acrylic having dimensions essentially the same as those of the clear zone, the security label having a thickness essentially one-half the thickness of the pressure-sensitive adhesive coating, the security label having identifying indicia fixedly inscribed on one side, the security label being disposed on a plane parallel to the plane of the base component in touching relationship with the base component within the clear zone of the adhesive coating whereby the indicia may be viewed through the transparent material of the base component;

a glue capsule fixedly connected to the side of the security label opposite the inscribed indicia, the glue capsule comprising:

a thin-walled hollow bladder having a length and width slightly smaller that of the security label, the bladder having an overall thickness essentially one-half that of the adhesive coating of the base component, the bladder also having a liquid anaerobic adhesive such as cyanoacrylate ester therein, the bladder being formed of pliable easily burst material whereby normal pressure exerted on the pressure-sensitive adhesive during installation of the index tab will cause the bladder to rupture whereby the liquid anaerobic adhesive flows between the security label and the tape or compact disc case to form a permanent bond; and release paper releasedly applied over the exposed surface of the pressure-sensitive adhesive whereby protecting the adhesive prior to use, the release paper also being applied over the security label and glue capsule whereby retaining the security label and glue capsule captively in place prior to installation of the index tab.

3. The index tab of claim 1 wherein the transparent material is colored whereby the indexed items may be color-coded for quick visual identification of a category or group of items.

4. A new and improved index tab for identifying each individual video tape, audio tape, compact disc, or the like in a collection whereby an index tab having identifying indicia is affixed to the outside of the case containing the tape or disc, the tab being positioned to project beyond the edge of the case and being adjustable over two viewing angles when the case is set on the opposite edge so the indicia printed thereon may be easily viewed without requiring movement of the case or assumption of an uncomfortable body position by the viewer, the index tab comprising:

an upper display component formed from a strip of thin stiff flexible transparent material such as plastic, the upper display component being laterally folded back upon itself parallel to the fixed plane whereby a pocket with an open bottom and open sides is formed, the upper display component also having a lateral raised shoulder formed therein immediately below the open bottom of the pocket whereby blocking the opening, the upper display component further having a lateral slot therethrough located parallel with and below the lateral raised shoulder;

a lower base component formed from the same material as the upper display component, the lower base component having a width essentially the same as the width of the lateral slot of the upper display component, the lower base component having at the top a series of lateral corrugations formed therein, the corrugated top of the lower base component snapidly hingedly cooperatively extending through the lateral slot of the upper display component such that the upper display component rotates on the lower base component about the slot whereby the corrugations form a two-position detent whereby the upper display component may be adjusted so it is either coplanar with the lower base component or angled with respect to the plane of the lower base component, the lower base component also having at the bottom a planar section having a coating of pressure-sensitive adhesive on one side whereby the index tab may be attached to the tape or compact disc case, the lower base component further having release paper releasedly applied over the exposed surface of the pressure-sensitive adhesive whereby protecting the adhesive prior to use; and a planar label formed of stiff paper or the like having a surface suitable for writing upon, the label having a generally rectangular shape, the label having a length and width and thickness corresponding to the inside space of the pocket of the upper display component, the label being releasedly slippedly received inside the pocket such that indicia printed on the label is visible through the transparent plastic of the clip display component.

* * * * *